US005634220A

United States Patent [19]

Chiu

[11] Patent Number: 5,634,220

[45] Date of Patent: Jun. 3, 1997

[54] DOUBLE-FUNCTIONAL FAUCET STRUCTURE

[76] Inventor: Hung-Li Chiu, No. 20, Lane 22, Wu Chang Street, Sec. 1, Taipei, Taiwan

[21] Appl. No.: 525,164

[22] Filed: Sep. 8, 1995

Related U.S. Application Data

[63] Continuation-in-part of Ser. No. 275,433, Jul. 15, 1994, abandoned.

[51] Int. Cl.[6] ..... E03C 1/04

[52] U.S. Cl. ..... 4/678; 137/801; 137/876; 239/446; 239/448

[58] Field of Search ..... 4/675–678; 239/445, 239/446, 448; 137/625.17, 801, 876

[56] References Cited

U.S. PATENT DOCUMENTS

| | | | |
|---|---|---|---|
| 370,836 | 10/1887 | Wilkins | 239/448 |
| 3,490,493 | 1/1970 | Eversman | 137/625.17 |
| 3,750,708 | 8/1973 | Staat et al. | 137/625.17 |
| 5,158,234 | 10/1992 | Magnenat et al. | 4/678 |
| 5,358,213 | 10/1994 | Pilolla | 137/625.17 X |

FOREIGN PATENT DOCUMENTS

| | | | |
|---|---|---|---|
| 0577164 | 1/1994 | European Pat. Off. | 4/676 |

*Primary Examiner*—Charles E. Phillips
*Attorney, Agent, or Firm*—Browdy and Neimark

[57] ABSTRACT

A double-functional faucet structure including a water discharging tube communicated with a water supplying opening of a water supplying tube and a stepped hollow cylindrical valve shaft fitted in the water supplying opening. The interior of the water discharging tube is divided into a small passage and a large passage and the valve shaft is formed with a first water inlet and a second water inlet which are respectively communicated with the small and large passages of the water discharging tube. A switch handle is operated to alternatively discharge the water from the small passage at a reduced amount or from the large passage at a normal amount. A nozzle is disposed in a free end of the small passage, making the water flow out therefrom in a fog pattern.

7 Claims, 3 Drawing Sheets

DOUBLE-FUNCTIONAL FAUCET STRUCTURE

This application is a C.I.P. of application Ser. No. 08/275,433, filed Jul. 15, 1994, abandoned, the contents of which are hereby incorporated by reference.

BACKGROUND OF THE INVENTION

The present invention relates to an improved faucet structure, and more particularly to a double-functional faucet structure which can be controlled to alternatively discharge a large or a small amount of water.

A conventional faucet includes a switch and a water discharging tube. The switch can be switched open to discharge water from the discharging tube. Such structure can be hardly controlled to discharge small amount of water and once the switch is opened the water will flow out of the faucet by an unnecessarily large amount. This causes waste of water. Moreover, the water rushing out of the faucet may splash on a user's body or clothes.

Therefore, it is necessary to provide an improved faucet to eliminate the above shortcomings.

SUMMARY OF THE INVENTION

It is a primary object of the present invention to provide an improved double-functional faucet structure which includes a faucet body having a water discharging tube the interior of which is divided into an upper small passage and a lower large passage, a valve shaft formed with a first water inlet communicating with the small passage and a second water inlet communicating with the large passage and a switch assembly having a switch handle. The switch handle can be rotated counterclockwise or clockwise to alternatively discharge water from the small passage in a mist at a reduced amount or from the large passage in a stream at a normal amount. In addition, the switch handle can be pulled upward or pressed downward to optionally supply or shut off the water.

The present invention can be best understood through the following description and accompanying drawings, wherein:

DETAILED DESCRIPTION OF THE PREFERRED EMBODIMENT

Figure 1:
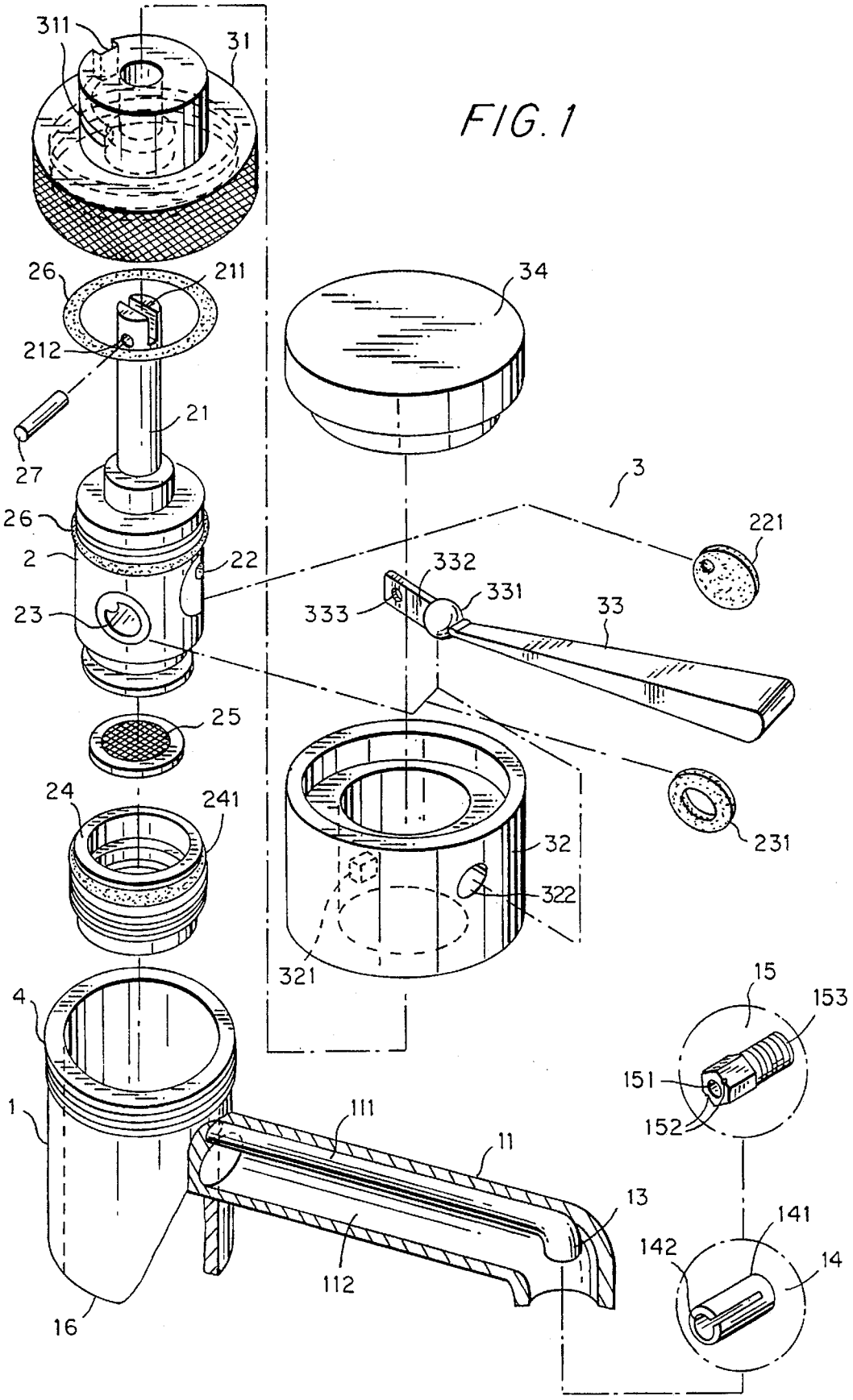
FIG. 1 is a perspective exploded view of the present invention.

Please refer to FIG. 1. The double-functional faucet structure of the present invention includes a faucet body 1, a valve shaft 2 and a switch assembly 3.

Figure 2:
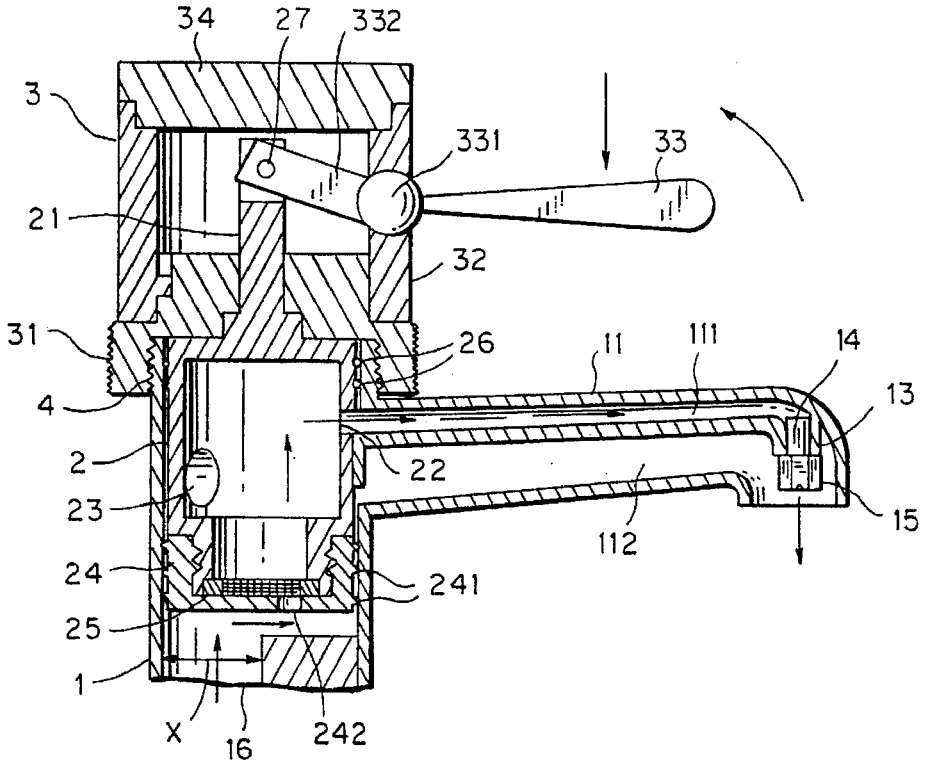
FIG. 2 is a sectional view showing that the switch handle is pulled upward and counterclockwise rotated to discharge the water from the small passage of the water discharging tube of the present invention.
Figure 3:
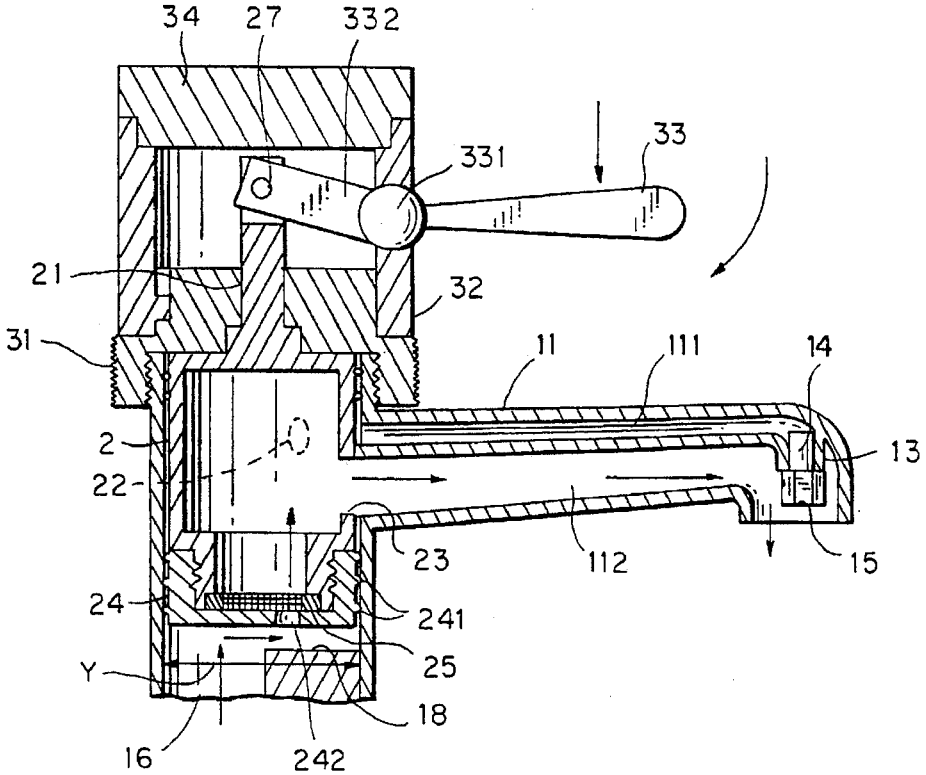
FIG. 3 is a sectional view according to FIG. 2, showing that the switch handle is pulled upward and clockwise rotated to discharge the water from the large passage of the water discharging tube of the present invention.

The faucet body 1 includes a water discharging tube 11 connected with a water supplying opening 16 of a water supplying tube. The faucet body 1 has an outer thread or threaded portion 4. As shown in FIGS. 2 and 3 the diameter X of the water supplying opening 16 is a half of the length of the inner diameter Y of the water supplying tube. This results in a shoulder 18 which acts to close inlet 242 as further discussed below. The water discharging tube 11 has an interior divided into an upper small passage 111 and a lower large passage 112. A distal end of the small passage 111 is formed with an inner thread 13 on which a nozzle 15 receiving a core member 14 is screwed. A front end of, the nozzle 15 is disposed with two notches 152 to facilitate unscrewing the nozzle 15 from passage 111 and a central portion of the nozzle 15 is formed with a water outlet 151.

The valve shaft 2 has a top stepped connecting rod 21 formed with a slot 211. A lower portion of the valve shaft 2 is formed with a first water inlet 22 communicating with the small passage 111 and a second water inlet 23 communicating with the large passage 112. A first and a second water sealing pads 221, 231 are respectively disposed on the first and second water inlets 111, 112. An annular groove is formed between the water inlets 22, 23 and the connecting rod 21 and a water sealing ring 26 is disposed in the annular groove. A water sealing sleeve 24 is threadedly fixed around an insert seat of a lower end of the valve shaft 2 and a filter screen 25 is fitted in the engaging seat of the valve shaft 2. The water sealing sleeve 24 has an outer annular water sealing ring 241 and a bottom water inlet 242.

The switch assembly 3 includes an inner sleeve 31 which is stepped and has inner lower thread portion and embossed outer periphery and an outer sleeve 32 having a hollow lower portion which rotates over inner sleeve 31 and an upper portion for receiving a handle 33. The inner lower thread portion of the inner sleeve 31 is screwed on the outer thread portion 4 of the faucet body 1. A protruded block 321 and a socket 322 are positioned in the outer sleeve 32. The handle 33 has a ball joint 331 at one end with a flat extension 332 connected to the ball joint 331. A fixing hole 333 is disposed on the end of the flat extension 332. The movable outer sleeve 32 is limitedly engaged with the inner sleeve 31 by way of the protruded block 321 of the outer sleeve 32 engaging with a corresponding recess 311 of the inner sleeve.

The top end of the connecting rod 21 is provided with slot 211 into which the flat extension 332 can be inserted and the operation handle 33 can be fixedly engaged to the valve shaft 2 by a pin 27 which is led through the holes 212 and 333 of the connecting rod 21 and the flat extension 332 respectively after the flat extension 332 is led through the socket 322 with the ball joint 331 located in the socket 322.

The inner sleeve 31 and the valve shaft 2 are combined together with the top end of the connecting rod 21 extending beyond the top of the inner sleeve 31 so as to make the above described connection possible. Such connection permits the valve shaft 2 to be rotationally and vertically moved, causing the small and large water inlet 22, 23 to be in selective communication with small and large passages 111, 112 respectively. An upper cover 34 is fitted into a stepped hole on outer sleeve 32 to cover the engagement of switch assembly 33 to valve shaft 2.

When assembled, the water sealing pads 221, 231 are first disposed on the small and large water inlets 22, 23 and then the filter screen 25 is mounted in the insert seat of the valve shaft 2. Then, the water sealing sleeve 24 is fitted onto the insert seat of the valve shaft 2 and the water sealing ring 26 is disposed in the annular groove between the water inlets 22, 23 and the connecting rod 21. Then, the connecting rod 21 is passed through the central through hole of the inner sleeve 31 and the outer sleeve 32 is fitted with the inner sleeve 31 with a locating notch 331 of the locating plate 33 engaged to the protruded block 321 of the movable outer sleeve 32.

Then, the handle 33 is placed into the upper socket 332 of the outer sleeve 32 with flat extension 332 inserted into slot 211. The pin 27 is then inserted into corresponding holes 212 and 333. Valve shaft 2 is thereafter inserted into the faucet body 1 and the inner sleeve 31 is screwed on the faucet body 1. The core 14 is then placed into the nozzle 15. Finally, a screw driver is used to engage with the notches 152 beside the water exit 151 so as to screw the outer thread 153 of the nozzle 15 with the inner thread 13 of the small passage 111.

Please refer to FIG. 2. When it is desired to discharge the water as a mist, handle 33 is first counterclockwise rotated with the block 321 engaged in recess 317 to an extreme position and then the handle 33 is pulled upward lifting inlet 242 out of engagement with shoulder 18. At this time, the water will flow from the water supplying opening 16 through the interior of the valve shaft 2 and the first water inlet 22 into the small passage 111. The water then flows through the nozzle 15 and is discharged outside in a mist at a reduced amount.

Please refer to FIG. 3. When it is desired to discharge the water in a stream the switch handle 33 is rotated clockwise to an extreme position and pulled upward to lift inlet 242 out of engagement with shoulder 18. At this time, the water is discharged from the large passage 112 in a normal stream at a usual amount. When it is desired to stop discharging water, the switch handle 33 is pressed down to close both the first and second water inlets 22, 23 and shut off the water. The amount of water flowing out can be controlled by means of adjusting the rotating angle of the switch handle 33 as in a conventional faucet.

Figure 4:
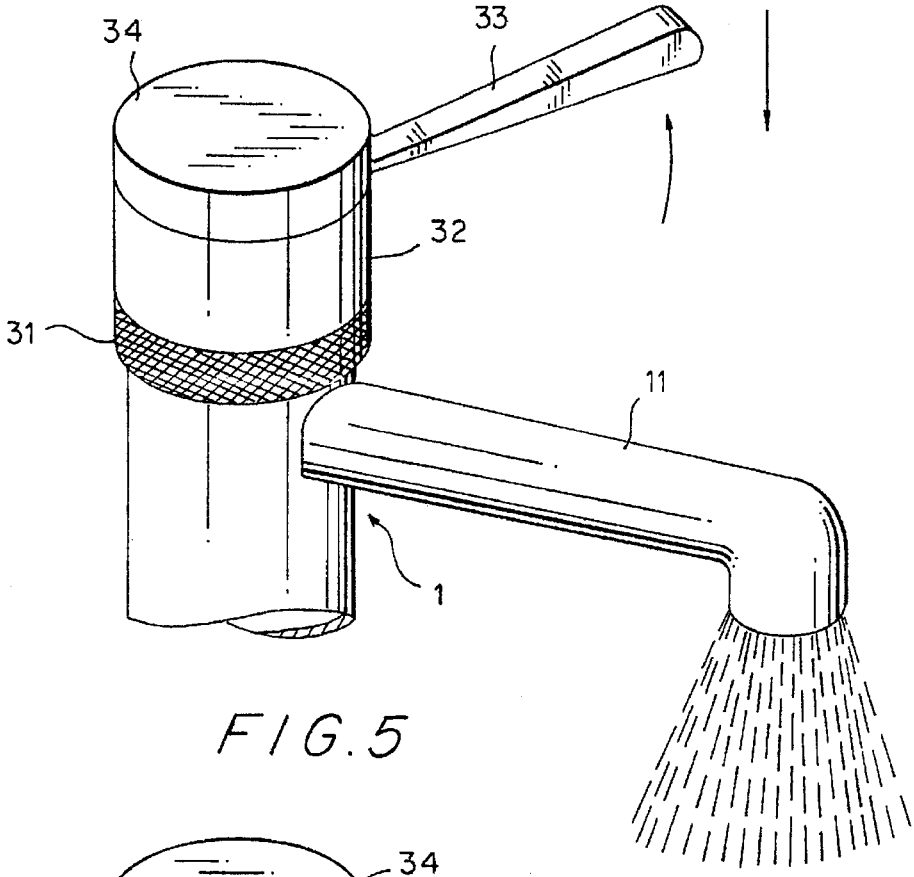
FIG. 4 shows that the switch handle is rotated to a right side, making the water discharged in a fog pattern at a reduced amount.
Figure 5:
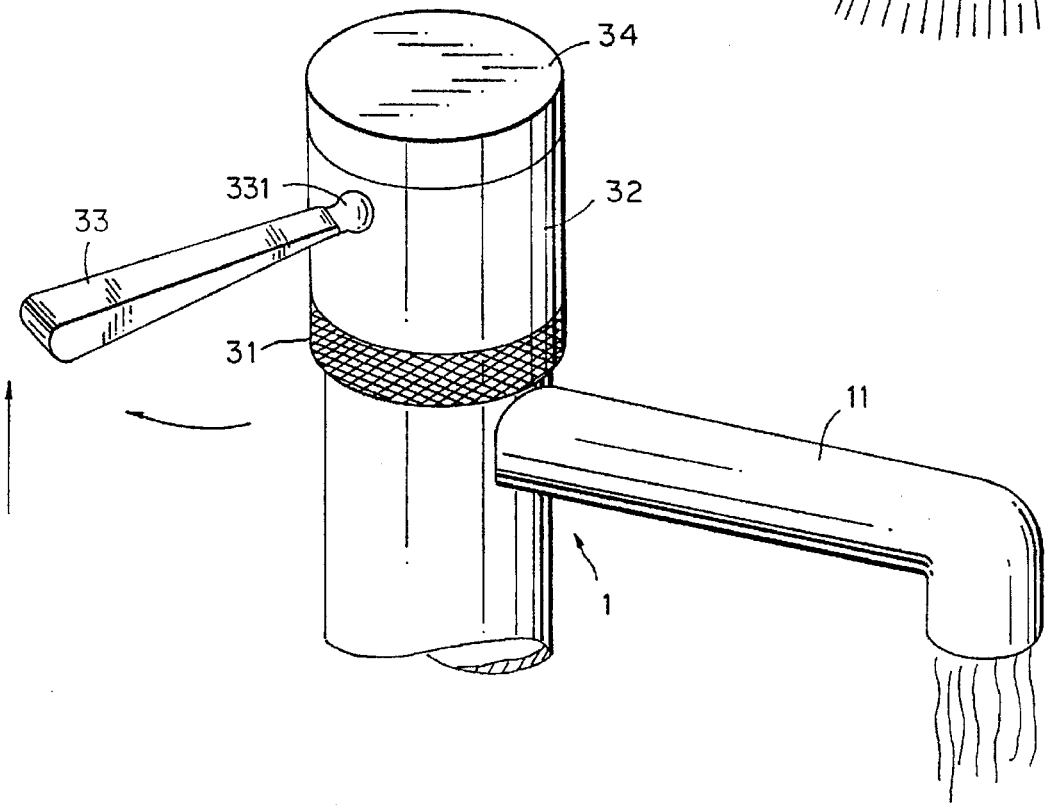
FIG. 5 shows that the switch handle is rotated to a left side, making the water discharged in a beam pattern at a normal amount.

Please refer to FIG. 4. When the switch handle 33 is rotated counterclockwise to a right side, the water is discharged from the nozzle 15 of the small passage in a mist. As shown in FIG. 5, when the switch handle 33 is rotated clockwise to a left side, the water is discharged from the large passage in a stream at a normal amount.

The above preferred embodiment is only an example of the present invention and the scope of the present invention should not be limited to the example. Any modification or variation derived from the example should fall within the scope of the present invention.

What is claimed is:

1. A double-functional faucet structure comprising:

a faucet body including a water discharging tube connected with a water supplying opening of a water supplying tube, said water discharging tube having an interior divided into an upper small passage and a lower large passage, a valve shaft having a connecting rod upstanding therefrom, said connecting rod having one end attached to said valve shaft and having a free end, a slot on the free end of said connecting rod, said valve shaft being formed with a first water inlet which communicates with said small passage and a second water inlet which communicates with said large passage, a water sealing sleeve having an inner water inlet engaged at a lower end of said valve shaft, said inner water inlet communicating with said water supplying opening to receive water discharged from said water supplying tube;

a switch assembly including a coaxially assembled inner sleeve and outer sleeve having a locating boss on said outer sleeve engaged in a corresponding vertical groove on said inner sleeve, said inner sleeve having an inner lower threaded portion, said outer sleeve having a hollow lower portion and a socket for receiving a switch handle, said inner lower threaded portion of the inner sleeve being screwed on an outer threaded portion on said faucet body, said switch handle being formed with a ball-joint and a flat extension fixed to said ball-joint, said ball joint rotatably engaged in said socket and said flat extension being rotatably retained in said slot on said connecting rod, whereby when said handle is rotated counterclockwise or clockwise and said handle is pulled upwardly, said inner water inlet communicates with said water supplying opening to supply water to said valve shaft with said locating boss slidably engaged in said groove, said water is respectively discharged from said small passage in a mist at a reduced amount and from said large passage in a stream at a normal amount greater than said reduced amount.

2. The faucet structure according to claim 1, wherein a diameter of the water supplying opening is half of the length of an inner diameter of said water supplying tube to form a shoulder, said inner water inlet on said valve shaft being positioned above said shoulder to open and close entry of water from said water supplying opening.

3. The faucet structure according to claim 1, further comprising an upper cover fitted into a stepped hole on said outer sleeve to cover engagement of said flat extension and said slot.

4. The faucet structure according to claim 1, wherein a distal end of-said small passage is formed with an inner thread on which a nozzle having a core member is screwed, a front end of said nozzle having a central water outlet.

5. The faucet structure according to claim 1, wherein a first and a second water sealing pads are respectively disposed on said first water inlet and second water inlet and, an annular groove is formed between said first water inlet, said second water inlet and said connecting rod and a water sealing ring is disposed in said annular groove.

6. The faucet structure according to claim 1, wherein said water sealing sleeve has an outer annular water sealing ring.

7. The faucet structure according to claim 1, wherein said inner sleeve is stepped and has an embossed outer periphery.

* * * * *